US007017872B2

(12) United States Patent
Hogle et al.

(10) Patent No.: US 7,017,872 B2
(45) Date of Patent: Mar. 28, 2006

(54) HEIGHT ADJUSTABLE BOAT SEAT PEDESTAL

(75) Inventors: Steve Hogle, Six Lakes, MI (US); Jamie Payne, Grand Rapids, MI (US)

(73) Assignee: Attwood Corporation, Lowell, MI (US)

( * ) Notice: Subject to any disclaimer, the term of this patent is extended or adjusted under 35 U.S.C. 154(b) by 0 days.

(21) Appl. No.: 10/689,212

(22) Filed: Oct. 20, 2003

(65) Prior Publication Data

US 2005/0082443 A1 Apr. 21, 2005

(51) Int. Cl.
*F16M 11/00* (2006.01)

(52) U.S. Cl. ..... 248/162.1; 248/404; 267/64.12; 267/64.01; 297/463.1

(58) Field of Classification Search ..... 248/161, 248/162.1, 404, 157, 631, 634, 635, 616, 248/618, 188.5; 267/64.12, 64.01, 131; 297/463.1
See application file for complete search history.

(56) References Cited

U.S. PATENT DOCUMENTS

| | | | | |
|---|---|---|---|---|
| 4,720,068 | A | 1/1988 | Tornero | |
| 5,435,529 | A * | 7/1995 | Day et al. | 267/64.12 |
| 5,462,248 | A * | 10/1995 | Bauer | 248/161 |
| 5,497,966 | A | 3/1996 | Fuhrmann | |
| 5,556,170 | A | 9/1996 | Lai et al. | |
| 5,683,139 | A * | 11/1997 | Golynsky et al. | 297/302.3 |
| 5,702,083 | A | 12/1997 | Lai | |
| 5,944,290 | A * | 8/1999 | Fuhrmann et al. | 248/161 |
| 5,992,815 | A * | 11/1999 | Metzdorf et al. | 248/631 |
| 6,241,316 | B1 | 6/2001 | Jean et al. | |
| 6,267,337 | B1 | 7/2001 | Kulhavy | |
| 6,276,756 | B1 | 8/2001 | Cho et al. | |
| 6,439,662 | B1 | 8/2002 | Ma | |
| 6,474,619 | B1 | 11/2002 | Ma | |
| 6,481,675 | B1 | 11/2002 | Yoon | |
| 2002/0109052 | A1 * | 8/2002 | Jeon et al. | 248/161 |
| 2002/0162922 | A1 * | 11/2002 | Yoon | 248/161 |
| 2004/0041063 | A1 * | 3/2004 | Enders et al. | 248/161 |
| 2004/0108423 | A1 * | 6/2004 | Boaro et al. | 248/161 |
| 2004/0124570 | A1 * | 7/2004 | Huh et al. | 267/64.12 |

FOREIGN PATENT DOCUMENTS

| | | |
|---|---|---|
| EP | 0133523 | 2/1985 |
| EP | 0566045 | 10/1993 |
| NL | DE 4426846 | 12/1994 |

* cited by examiner

*Primary Examiner*—Ramon O Ramirez
(74) *Attorney, Agent, or Firm*—Price, Heneveld, Cooper, DeWitt & Litton, LLP

(57) ABSTRACT

A pedestal assembly for supporting a seat including a first cylinder having an inner surface with a plurality of longitudinally-extending channels, and a second cylinder having an inner surface with a plurality of longitudinally-extending channels and an outer surface with a plurality of longitudinally-extending grooves. The assembly also includes a first bushing that is operably coupled to one end of the second cylinder by a plurality of fasteners received within an end of the channels of the second cylinder, and a second bushing that is operably coupled to one end of the first cylinder by a plurality of fasteners received within an end of the channels of the first cylinder. The second bushing includes a plurality of tabs slidably received within the channels on the inner surface of the first cylinder and is adapted to telescopingly guide the second cylinder within the first cylinder.

21 Claims, 4 Drawing Sheets

HEIGHT ADJUSTABLE BOAT SEAT PEDESTAL

BACKGROUND OF THE INVENTION

The present invention pertains to a seat pedestal and more particularly to a height adjustable boat seat pedestal.

Adjustable seat pedestals that allow a user to raise or lower the height of an associated and supported boat seat according to the user's requirements are well known. With the demand and requirements toward easily operable, lightweight and durable seating systems on the rise, boat owners and boat manufacturers are increasingly particular about the products they purchase and/or install on their boats. These seat pedestals typically include at least two telescoping cylinders and a height adjustment device connected directly to the cylinders for adjusting the cooperative length of the cylinders.

Heretofore, seat pedestals have been designed with an emphasis on durability with spatial constraints being less considered. The relatively large cylinders associated with these seat pedestals are significantly heavy, as are the mechanisms involved with the adjustability of the seat pedestal. The resulting excessive weight of the seat pedestals is unacceptable to both boat manufacturers and operators seeking to reduce the weight of their boats in order to gain increased fuel economy and allow for more cargo to be supported by a given boat plan. Moreover, complex adjustment mechanisms prevent or inhibit boat owners from maintaining the seat pedestal, thereby requiring service by trained and relatively expensive technicians.

Accordingly, an adjustable seat pedestal is desired that is relatively lightweight and low cost, while simultaneously having an uncomplicated design that may be operated and maintained by even unskilled persons, is versatile between varying seating configurations and requirements, and is capable of a long operating lift.

SUMMARY OF THE INVENTION

The present invention includes a pedestal assembly for supporting a seat having a first cylinder, and a second cylinder including a first end, an inner surface and at least one longitudinally-extending channel. The pedestal assembly also includes a first bushing operably coupled to the first end of the second cylinder via at least one mechanical fastener received within the least one receiving member of the second cylinder. The first bushing includes at least one groove slidably receiving the at least one receiving member and is adapted to telescopingly guide the second cylinder within the first cylinder.

In another aspect of the present invention, a pedestal assembly for supporting a boat seat includes a tubular shaped first pedestal member, and a tubular shaped second pedestal member which is telescopingly received within the first pedestal member. A pneumatic cylinder is provided and operably coupled to the first and second pedestal members for telescopingly actuating the pedestal members relative to one another. The pneumatic cylinder includes an actuator switch which is actuated by moving the switch in a relatively transverse direction with respect to the longitudinal axis of the pneumatic cylinder.

In yet another aspect of the present invention, a pedestal assembly for supporting a boat seat includes a first cylinder with a plurality of longitudinally-extending channels disposed on its inner surface, and a second cylinder including a first end, an inner surface, and a plurality of longitudinally-extending channels disposed on the inner surface, wherein the second cylinder is telescopingly received within the first cylinder. A first bushing is operably coupled to the first end of the second cylinder via a plurality of mechanical fasteners received within the plurality of channels of the second cylinder, and includes a plurality of grooves which slidably receive the channels on the inner surface of the first cylinder and is adapted to telescopingly guide the second cylinder within the first cylinder. A second bushing is operably coupled to a first end of the first cylinder via a plurality of mechanical fasteners received within the channels of the first member and includes a plurality of tabs slidably received within the grooves of the second cylinder and the fist bushing. A pneumatic cylinder is also provided and operably coupled to the first and second cylinders for telescopingly actuating the cylinders relative to one another and includes an actuator switch wherein the pneumatic cylinder is actuated by moving the switch in a relatively transverse direction with respect to the longitudinal axis of the cylinder.

The present inventive seat pedestal is relatively lightweight and low cost, and includes an uncomplicated design that may be easily operated by even unskilled persons. The seat pedestal is highly versatile, and may be utilized within a wide variety of seating plans and configurations, is efficient in use, capable of a long operating light, and is particularly well adapted for the proposed use.

These and other features, advantages and objects of the present invention will become apparent to a person of ordinary skill upon reading the following description and claims together with reference to the accompanying drawings.

DETAILED DESCRIPTION OF THE PREFERRED EMBODIMENT

Figure 1:
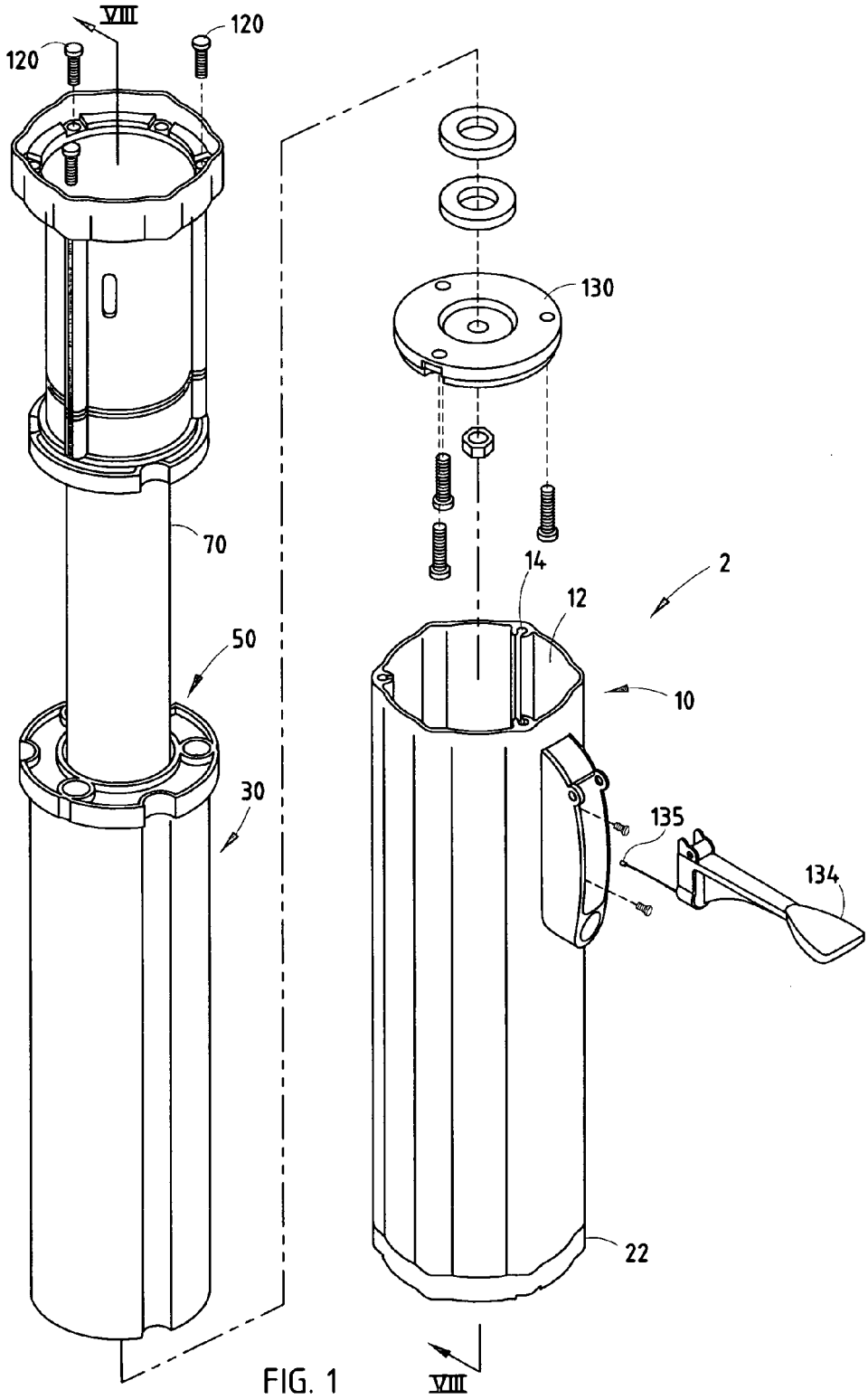
FIG. 1 is an exploded perspective view of the adjustable seat pedestal embodying the present invention.
Figure 9:
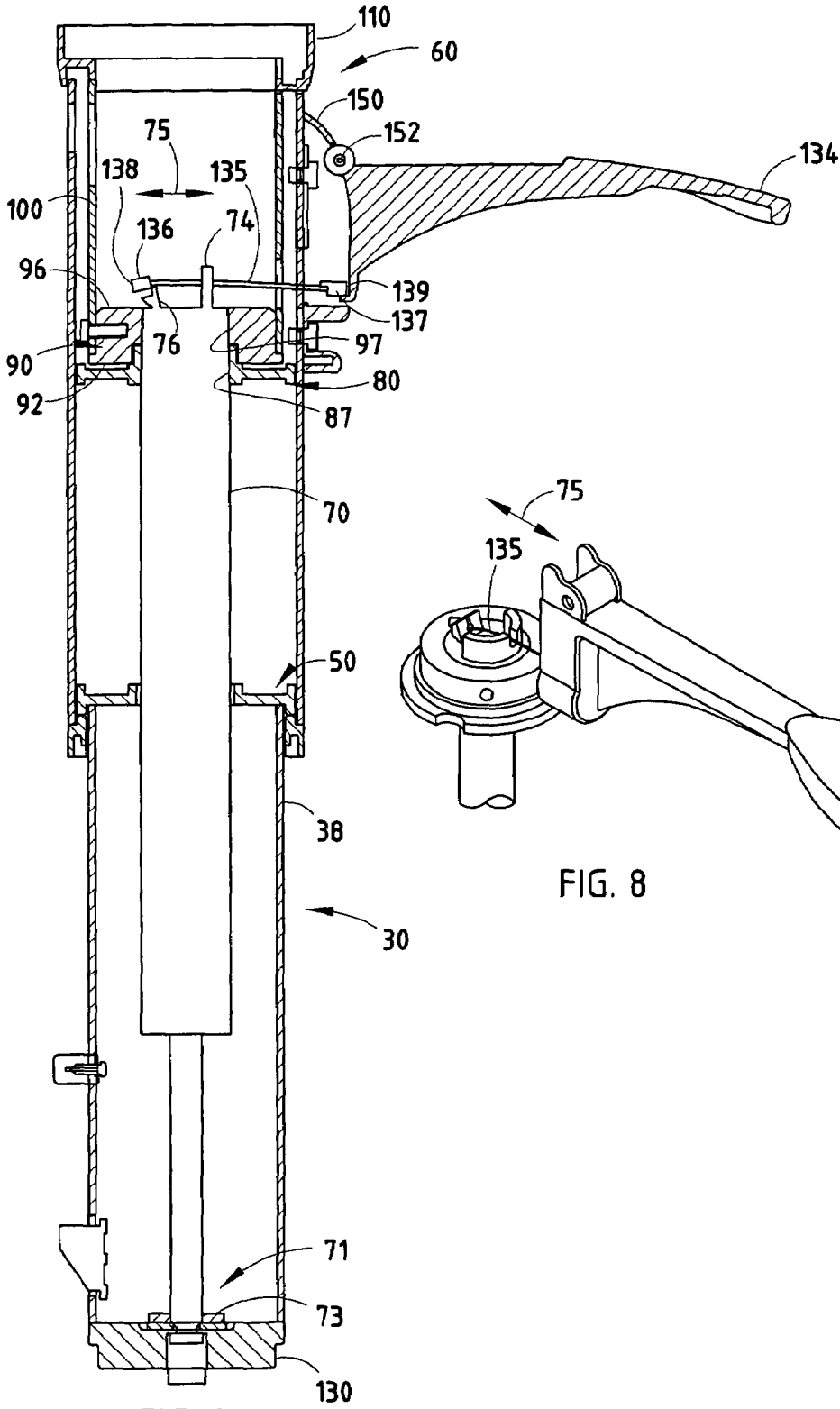
FIG. 9 is a cross-sectional view of the adjustable seat pedestal taken along line VIII—VIII in FIG. 1.

For purposes of description herein, the terms "upper," "lower," "right," "left," "rear," "front," "vertical," "horizontal," and derivatives thereof shall relate to the invention as oriented in FIGS. 1 and 9. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
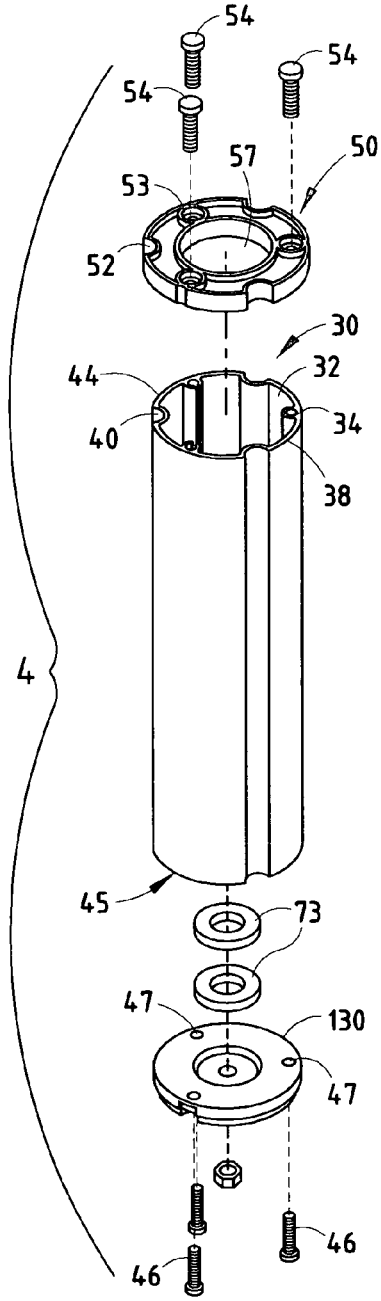
FIG. 4 is an exploded perspective view of a second cylinder and a first bushing.

An adjustable seat pedestal 2 (FIG. 1) includes a first cylinder 10 including an inner surface 12 having a plurality of longitudinally-extending channels 14 disposed therein. The seat pedestal further includes a second cylinder 30 that includes a plurality of longitudinally-extending channels 34 (FIG. 4) disposed on an inner surface 32, wherein the second cylinder 30 is telescopingly received within the first cylinder 10. A first bushing 50 is operably coupled to one end 44 of the second cylinder 30, while a second bushing or end plug 22 is operably coupled to an end 24 of the first cylinder 10. The first and second bushings 50, 52 telescopingly guide the second cylinder 30 within the first cylinder 10.

Figure 2:
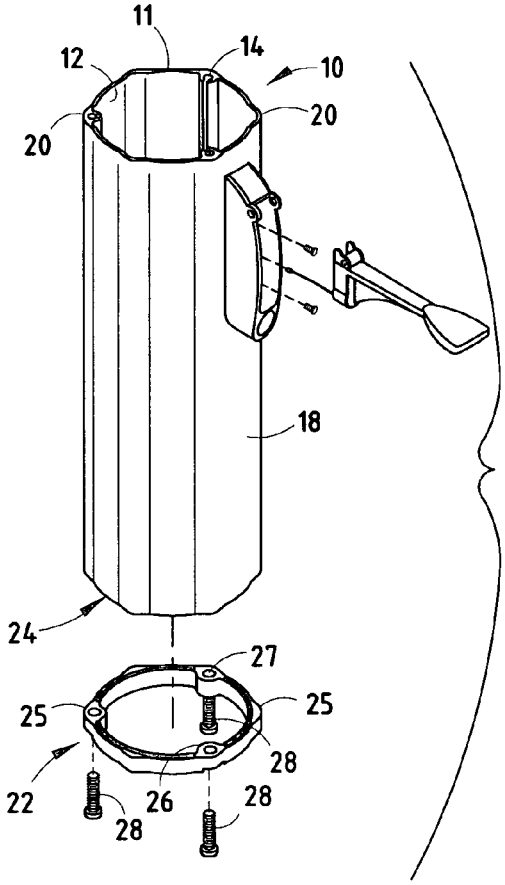
FIG. 2 is an exploded perspective view of a first cylinder and an end plug or bushing.
Figure 3:
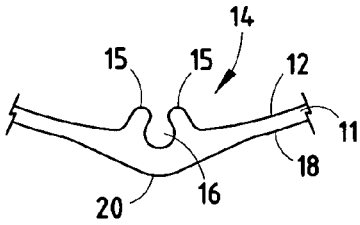
FIG. 3 is a sectional plan view of a channel of the first cylinder.

In the illustrated example, the first cylinder 10 is provided a circularly-shaped cross-sectional geometry. The first cylinder 10 (FIGS. 2 and 3) includes a plurality of longitudinally-extending channels 14 disposed on the inner surface 12 of an outer wall 11 and are partially disposed therein. The channels 14 may be fabricated in numerous geometrical patterns depending on the specific requirements, and may be fabricated by numerous processes such as machining, welding or molding. In the preferred embodiment, the first cylinder 10 and the channels 14 are integrally formed via a continuous extrusion process, and are constructed of an aluminum, stainless steel, or other corrosive resistant rusting material. The channels 14 are formed into a generally C-shaped geometry having distal ends 15, a rear portion 20 extending outwardly from an outer surface 18 of the outer wall 11, and a center cavity or fastener receiving opening 16.

Figure 5:
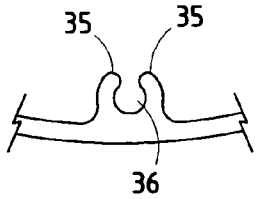
FIG. 5 is a sectional plan view of a channel of the second cylinder.

The second cylinder 30 has a generally circular cross-sectional shape and is fabricated in the same manner and material as the first cylinder 10. The channels 34 (FIG. 5) of the second cylinder 30 are similar in shape and configuration to the channels 14 of the first cylinder 10 and include distal ends 35 and a center cavity or fastener receiving opening 36. Similar to the first cylinder 10 as discussed above, the channels 34 are preferably integrally fabricated with the second cylinder 30 during a continuous extrusion process, and are preferably constructed from an aluminum, stainless steel or other corrosive resistant material. Additionally, a plurality of inwardly formed arcuate grooves 40 are disposed on an outer surface 38 of the second cylinder 30.

The bushing 22 includes a plurality of exterior protrusions 25 which are consistent in shape to the corresponding longitudinally-extending channels 20 disposed on the outer surface 18 of the first cylinder 10. A plurality of inwardly-extending protrusions or tabs 26 are correspondingly similar in profile and size to the longitudinally-extending channels 40 disposed on the outer surface 38 of the second cylinder 30. The interior protrusions 26 slidingly engage the channels 40 when the second cylinder 30 is telescopingly engaged within the first cylinder 10. The bushing 22 also includes a plurality of apertures 27 for receiving a plurality of mechanical fasteners or screws 28 therethrough. In assembly, the bushing 22 is positioned over the end 24 of the first cylinder 10 with the exterior protrusions 25, aligned with the channels 20, and the tabs 26 aligned with the channels 14. The bushing 22 is connected to the first cylinder 10 by extending the plurality of screws 28 through the corresponding plurality of apertures 27, and threading the screws 28 into the center cavities 16 of the channels 14. The bushing 22 is preferably constructed of a self-lubricating plastic, however, other suitable materials may be used therefore.

The bushing 50 includes a plurality of grooves 52 disposed on the outer periphery thereof and corresponding to the grooves 40 of the second cylinder 30. The bushing 50 further includes a plurality of fastener receiving apertures 53. In assembly, the grooves 52 of the bushing 50 are aligned with the grooves 40 of the second cylinder 30. A plurality of screws 54 are then extended through the apertures 53 of the bushing 50 and are threadably received within the center cavities 36 of the channels 34 of the second cylinder 30. The bushing 50 is constructed similarly to the bushing 22.

Figure 6:
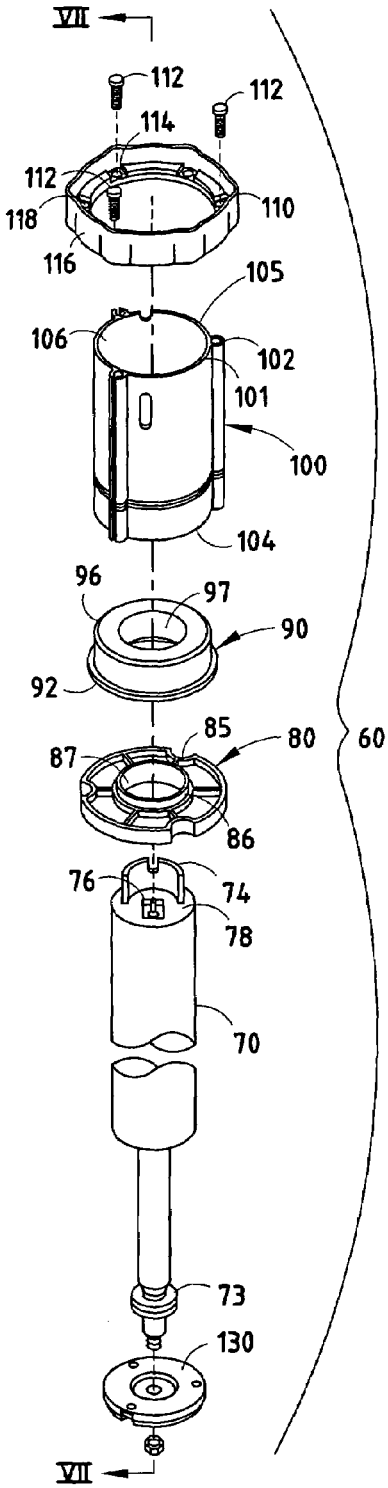
FIG. 6 is an exploded view of an inner assembly.
Figure 7:
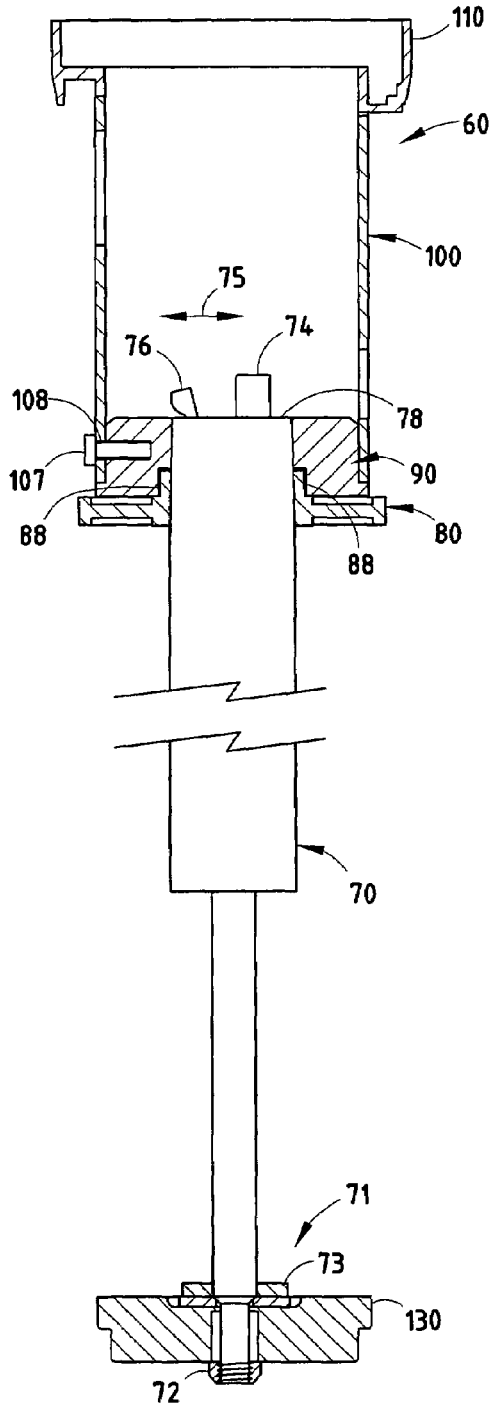
FIG. 7 is a cross sectional front view of the inner assembly taken along line VII—VII in FIG. 6.

The seat pedestal 2 includes an inner assembly 60 comprising a pneumatic cylinder 70, a bushing 80, a taper lock bushing 90, a third cylinder 100 and a second ring-shaped end plug 110 (FIG. 6). The pneumatic cylinder 70 includes support bracket 74 and an actuator switch 76 disposed at one end 71, and a nut 72 (FIG. 7) and a washer 73 disposed at opposite end 78. The actuator switch 76 operates the pneumatic cylinder 70 by moving in a transverse direction relative to a longitudinal axis of the cylinder 70, as indicated and represented by directional arrow 75. The actuator switch 76 is biased towards an unactivated position. Preferably, the pneumatic cylinder 70 is a gas charged cylinder, however, it is to be understood that various pneumatic cylinders may be used.

The second bushing 80 is generally of a shape that matches the inner surface 12 of the first cylinder 10 and includes a plurality of channels 85 and a tapered central aperture 87 surrounded by a collar 86. The taper lock bushing 90 includes an outer diameter 96, a tapered central aperture 97, a recess 88 and an outer diameter 96 is configured to fit inside an end 104 of the third cylinder 100, as discussed below. Both the second bushing 80 and the taper lock bushing 90 are press fit onto the end 78 of the pneumatic cylinder 70. Alternatively, the central apertures 87, 97 may be cylindrically shaped, and the end of pneumatic cylinder 70 may be tapered to frictionally hold the bushings 80 and 90 thereon via a press-fit.

The third cylinder 100 includes an outer wall 101 having a plurality of longitudinally-extending channels 102 that are similar in shape to the channels 34 of the second cylinder 30 described above. The third cylinder 100 also includes a first end 104, a second end 105 and an inner diameter 106. The taper lock bushing 90 is coupled with the third cylinder 100 by press-fitting the outer diameter 96 of the bushing 90 into the inner diameter 106 of the cylinder. The bushing 80 is assembled with the bushing 90 by press-fitting the collar 86 of the bushing 80 into the recess 88 of the bushing 90. Alternatively, other methods for connecting the components together may be utilized, such as a pin 107 extending through the outer wall 101 of the third cylinder 100 and into the bushing 90.

The end plug 110 includes a plurality of fastener receiving apertures 114 extending therethrough, and is configured to generally correspond to the outer surface 18 of the first cylinder 10. In assembly, the end plug 110 is connected to an end 105 of third cylinder 100 via a plurality of screws 112 that extend through the apertures 114 and are threadably received within the channels 102.

In assembly, the aperture 57 of the first bushing 50 slidably receives the pneumatic cylinder 70. The first cylinder 10 is then concentrically positioned with and slid onto the second cylinder 30 by aligning the interior protrusions 26 of the bushing 22 with the grooves 40 of the second cylinder 30 and slidingly engaging the protrusions 26 with the grooves 40. The end 71 of the pneumatic cylinder 70 is affixed to an end cap 130 by the nut 72 and the plurality of washers 73. The end cap 130 is fixedly mounted to the second end 45 of the second cylinder 30 with a plurality of screws being disposed through a plurality of apertures 47 and secured the channels 34 within the end 45 of second cylinder 30 as described previously. The end plug 110 of inner assembly 60 is secured to the channels 14 of first cylinder 10 to complete the tube assembly.

Figure 8:
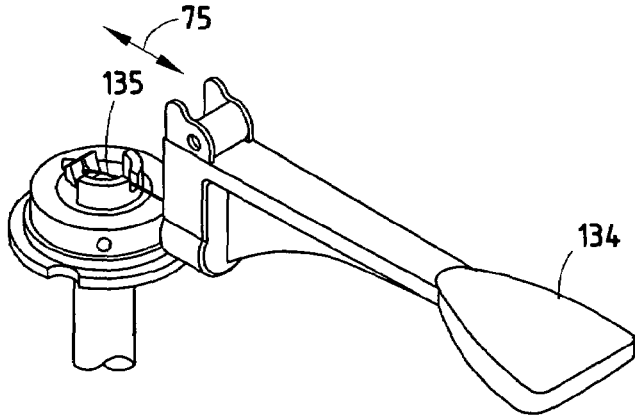
FIG. 8 is a partial perspective view of a handle and a cylinder actuator mechanism.

A handle 134 (FIGS. 8 and 9) is pivotally mounted to a mounting bracket 150 extending outwardly from the first cylinder 10 via a pivot pin 152. A cable 135 having a proximate end 136 and a distal end 137 is operably connected to the actuator switch 76 of the cylinder 70 and the handle 134. The cable ends 136 and 137 are crimpingly fitted with end portions or stop members 138 and 139, respectively, that when handle 134 is moved in a direction which pulls on cable 135, actuator 76 is actuated and are connected to the actuator switch 76 and the handle 134 via slots (not shown) in the actuator switch 76 and the handle 134 that allows the switch cable 135 to pass through while simultaneously retaining the end portions 138 and 139.

In operation, the seat pedestal 2 may be adjusted by pivoting the handle 134 which displaces the cable 135 to actuate the actuator switch 76, thereby causing the pneumatic cylinder 70 to increase or decrease in length depending on whether a user is seated on a supported seat (not shown). The interior protrusions 26 of the bushing 22 telescopingly slides on the grooves 40 of the second cylinder 30. The bushing 50 telescopingly slides over the channels 14 on the interior surface 12 of the first cylinder 10. The second cylinder 30 is prevented from canting within the first cylinder 10 by the bushing 22 and the bushing 50, wherein the aperture 57 of the bushing 50 slidingly surrounds the pneumatic cylinder 70 and the exterior of the bushing 50 slidingly engages the inside of the first cylinder 10 while the bushing 22 slidingly engages the exterior of the second cylinder 30, thereby preventing the end 44 of the second cylinder 30 from tilting or canting within the first cylinder 10.

The seat pedestal of the present inventive concept allows the cable end 137 of the cable 135 to be disposed, not only on a handle lever or other cable pulling mechanism connected directly to the first and/or second cylinders 10, 30, but also on a handle, lever, or cable pulling mechanism which is remotely located from the first and second cylinders 10, 30, thus allowing the adjustable seat pedestal 2 to be remotely operated.

Therefore, an adjustable seat pedestal has been developed which prevents canting between the first and second cylinders allowing for smooth height adjustment, the height adjustment being capable of being initiated from a remote location, while being lightweight, of low complexity and aesthetically pleasing. The seat pedestal is further high versatile and may be utilized within a wide variety of seating plans and configurations, is efficient in use, capable of a long operating life, and is particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A pedestal assembly for supporting a boat seat, comprising:

a first cylinder;

a second cylinder including a first end, an inner surface and at least one receiving member disposed on the inner surface and extending inwardly therefrom, the second cylinder telescopingly received within the first cylinder; and a first bushing operably coupled to the first end of the second cylinder via at least one mechanical fastener received within the at least one receiving member of the second cylinder, and including at least one groove slidably receiving at least one receiving member and wherein the first bushing is adapted to telescopingly guide the second cylinder within the first cylinder.

2. The pedestal assembly of claim 1, wherein the at least one receiving member comprises a plurality of integrally molded, longitudinally-extending channels.

3. The pedestal assembly of claim 2, wherein the first cylinder includes a first end and at least one receiving member disposed on an inner surface of the cylinder and extending inwardly therefrom, and wherein the second cylinder further includes at least one longitudinally-extending outer channel disposed on an outer surface of the second cylinder; and further including:

a second bushing operably coupled to the first end of the first cylinder via at least one mechanical fastener received within the at least one receiving member of the first cylinder, and including at least one tab member aligned with the at least one outer channel, and wherein the second bushing is adapted to telescopingly guide the second cylinder within the first cylinder.

4. The pedestal assembly of claim 3, wherein the at least one receiving member of the first cylinder comprises a plurality of integrally molded, longitudinally-extending channels.

5. The pedestal assembly of claim 4, further including:

a yoke assembly coupled to a second end of the first cylinder by a plurality of mechanical fasteners received within ends of the channels disposed on the inner surface of the first cylinder.

6. The pedestal assembly of claim 5, further including:

a ring-shaped end plug coupled to a second end of the second cylinder by a plurality of mechanical fasteners received within ends of the channels disposed on the inner surface of the second cylinder.

7. The pedestal assembly of claim 1, wherein the first cylinder includes a first end and at least one receiving member disposed on an inner surface of the cylinder and extending inwardly therefrom, and wherein the second cylinder further includes at least one longitudinally-extending outer channel disposed on an outer surface of the second cylinder; and further including:

a second bushing operably coupled to the first end of the first cylinder via at least one mechanical fastener received within the at least one receiving member of the first cylinder and including at least one tab member aligned with the at least one outer channel, and wherein the second bushing is adapted to telescopingly guide the second cylinder within the first cylinder.

8. The pedestal assembly of claim 7, wherein the at least one receiving member of the first cylinder comprises a plurality of integrally molded, longitudinally-extending channels.

9. The pedestal assembly of claim 8, further including:

a yoke assembly coupled to a second end of the first cylinder by a plurality of mechanical fasteners received within ends of the channels disposed on the inner surface of the first cylinder.

10. The pedestal assembly of claim 1, further including:

a ring-shaped end plug coupled to a second end of the second cylinder by a plurality of mechanical fasteners received within ends of the channels disposed on the inner surface of the second cylinder.

11. A pedestal assembly for supporting a boat seat, comprising:

a tubular-shaped first pedestal member;

a tubular-shaped second pedestal member telescopingly received within the first pedestal member; and a pneumatic cylinder operably coupled to the first pedestal member and the second pedestal member for telescopingly actuating the first pedestal member and the second pedestal members relative to one another, the cylinder including an actuator switch, wherein the cylinder is actuated by moving the actuator switch in a relatively transverse direction with respect to a longitudinal axis of the cylinder.

12. The pedestal assembly of claim 11, further including:

a cable operably coupled to the actuator switch.

13. The pedestal assembly of claim 12, wherein the cable includes at least one end remotely located from the first and second pedestal members.

14. The pedestal assembly of claim 12, further including:

an actuator handle pivotably coupled with a select one of the first and second pedestal members and operably coupled with the cable.

15. The pedestal assembly of claim 11, further including:

an actuator handle pivotably coupled with a select one of the first and second pedestal members and operably coupled with the actuator switch of the cylinder.

16. A pedestal assembly for supporting a boat seat, comprising:

a first cylinder including an inner surface and a plurality of longitudinally-extending channels disposed on the inner surface;

a second cylinder including a first end, an inner surface, an outer surface, a plurality of longitudinally-extending channels disposed on the inner surface, and a plurality of longitudinally-extending grooves extending into the outer surface, the second cylinder telescopingly received within the first cylinder;

a first bushing operably coupled to the first end of the second cylinder via a plurality of mechanical fasteners received within the plurality of channels disposed on the inner surface of the second cylinder, and including a plurality of grooves slidably receiving the channels on the inner surface of the first cylinder, the first bushing adapted to telescopingly guide the second cylinder within the first cylinder;

a second bushing operably coupled to a first end of the first cylinder via a plurality of mechanical fasteners received within the channels of the first member and including a plurality of tabs slidably received within the grooves of the second cylinder and the first bushing; and a pneumatic cylinder operably coupled to the first cylinder and the second cylinder for telescopingly actuating the first cylinder and the second cylinder relative to one another, the cylinder including an actuator switch, wherein the cylinder is actuated by moving the actuator switch in a relatively transverse direction with respect to a longitudinal axis of the cylinder.

17. The pedestal assembly of claim 16, further including:

a yoke assembly coupled to a second end of the first cylinder by a plurality of mechanical fasteners received within ends of the channels disposed on the inner surface of the first cylinder.

18. The pedestal assembly of claim 16, further including:

a ring-shaped end plug coupled to a second end of the second cylinder by a plurality of mechanical fasteners received within ends of the channels disposed on the inner surface of the second cylinder.

19. The pedestal assembly of claim 16, further including:

a cable operably coupled to the actuator switch.

20. The pedestal assembly of claim 19, wherein the cable includes at least one end remotely located from the first and second pedestal members.

21. The pedestal assembly of claim 19, further including:

an actuator handle pivotably coupled with a select one of the first and second pedestal members and operably coupled with the cable.

* * * * *